US009248331B1

(12) United States Patent
Collier et al.

(10) Patent No.: US 9,248,331 B1
(45) Date of Patent: Feb. 2, 2016

(54) RESISTANCE BAND WITH MARKINGS

(71) Applicant: Tiger Brands Athletics, Inc., Las Vegas, NV (US)

(72) Inventors: Edwin Collier, Las Vegas, NV (US); Theodore Whiting, Las Vegas, NV (US); Ronald Royce, Las Vegas, NV (US)

(73) Assignee: Tiger Brands Athletics, Inc., Las Vegas, NV (US)

( * ) Notice: Subject to any disclaimer, the term of this patent is extended or adjusted under 35 U.S.C. 154(b) by 215 days.

(21) Appl. No.: 14/055,248

(22) Filed: Oct. 16, 2013

Related U.S. Application Data

(60) Provisional application No. 61/854,978, filed on May 7, 2013.

(51) Int. Cl.
*A63B 21/055* (2006.01)

(52) U.S. Cl.
CPC ..... *A63B 21/0555* (2013.01)

(58) Field of Classification Search
CPC ..... A62B 21/00
USPC ..... 482/121, 126, 907
See application file for complete search history.

(56) References Cited

U.S. PATENT DOCUMENTS

| | | | | |
|---|---|---|---|---|
| 5,269,737 | A | 12/1993 | Sobotka | |
| 5,397,288 | A | 3/1995 | Sayre | |
| 5,816,984 | A | 10/1998 | Weiss | |
| 5,871,424 | A | 2/1999 | Conner | |
| 7,695,413 | B1 | 4/2010 | Cruz et al. | |
| 7,963,893 | B1 | 6/2011 | Cruz et al. | |
| 8,491,446 | B2 | 7/2013 | Hinds et al. | |
| 2002/0160891 | A1* | 10/2002 | Gallagher | 482/123 |
| 2011/0251033 | A1 | 10/2011 | Blancher | |
| 2012/0157273 | A1 | 6/2012 | Tussy | |
| 2012/0245002 | A1 | 9/2012 | Todd | |

* cited by examiner

*Primary Examiner* — Jerome w Donnelly
(74) *Attorney, Agent, or Firm* — Clause Eight IPS; Michael Catania

(57) ABSTRACT

A resistance band with markings is disclosed herein. Each of the markings is preferably a design selected from one of tiger stripes, ovals, ellipsis, hash tags, images, handprint shapes and footprint shapes. Preferably, a first marking is positioned between a center point and a first end on a first half of the main body, a second marking is positioned between the center point and a second end on a second half of the main body, a third marking is positioned between the first marking and the first end, and a fourth marking is positioned between the second marking and the second end.

18 Claims, 9 Drawing Sheets

RESISTANCE BAND WITH MARKINGS

CROSS REFERENCE TO RELATED APPLICATION

The present application claims priority to U.S. Provisional Patent Application No. 61/854,978, filed on May 7, 2013, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention generally relates to exercise devices. More specifically, the present invention relates to a resistance band.

2. Description of the Related Art

The prior art discusses various devices used for exercising related to the resistance band, such as resistance tubes, exercise bands, aerobic bands, and stretch bands. Resistance bands are one of the most effective forms of exercise for performing lower body, upper body and core conditioning. Resistance bands may be even more effective than a set of dumbbells, because it improves strength and balance. Furthermore, the ability to work in a full range of motion with resistance bands targets muscles that can be missed with weights. A full-body, strength-training workout can be done without going to the gym. This portable piece of exercise equipment has become highly popular, especially to those who are short on time, short on cash, and short on space. Due to its portability, flexibility, and light weight, the resistance band is travel friendly, enabling people to continue their work out regime while on vacation or on a business trip.

The major drawback of home exercise equipment is lack of user knowledge in proper use or proper form. Improper use or improper form can result in serious injuries, broken equipment, and/or lack of results. Thus, there is clearly a need for home exercise equipment that allows for proper use.

One such device is provided by Weiss, U.S. Pat. No. 5,816,984, for a Flexible Resistance Exerciser, which discloses adding indicators to serve to indicate a desirable location on the stretchable member to the user, to indicate a relative degree of resistance provided by the stretchable member, to indicate a degree of wear or fatigue to the stretchable member.

Another such device is provided by Castel et al., U.S. Patent Application Number 2007/0105696, for a Method and Apparatus for Physical Therapy Exercise, which discloses a tension indicator to indicate to the user when a predetermined level of tension is attained.

Yet another such device is provided by Block et al., U.S. Pat. No. 7,455,632, for an Exercise Device, which discloses an exercise device that includes indicia for measuring resistance force applied by the elongated tube during stretching of the elongated tube, and an indicator used to quantify the resistance force being applied. Terms used throughout this appplication may be used interchangeable for convenience of shortening the term or to avoid redundancy, such as "marked segment(s) 30" and "marking(s) 30"; "section" and "segment" in context of markings; and "band 25" and "resistance band 25".

Thus, there is a need for a resistance band that provides a means for proper use.

BRIEF SUMMARY OF THE INVENTION

The present invention provides a solution to the shortcomings of the prior art. The present invention is a resistance band that has markings at specific points of its length, with which users can better determine points of placement of the feet and/or hands during use to ensure a symmetrical workout and results. The present invention allows the center-point of a resistance band to be easily and accurately determined. The resistance band of the present invention can serve the established needs of millions who use resistance bands/tubes in exercise.

One aspect of the present invention is a resistance band. The band preferably has a main body with two ends and a center point. The first half of the main body extends from the center point to the first end and the second half of the main body extends from the center point to the second end. The band preferably includes four markings: a first marking positioned between the center point and the first end on the first half of the main body, a second marking positioned between the center point and the second end on the second half of the main body, a third marking positioned between the first marking and the first end of the main body, and a fourth marking positioned between the second marking and the second end of the main body.

The resistance band is produced of latex rubber in tubular format and in a length of 1,219-1,580 mm and an inside diameter of 6 mm with an outside diameter of 8.7-13.3 mm, or an inside diameter of 3 mm with an outside diameter of 14.3-16.8 mm. The resistance band has a body color of orange, and features encirclements (markings) in the form of black tiger stripes. Each of the markings is of three-inch (3") length and applied by dye. There are 10 other colors for the main body, however the invention is not limited to the colors illustrated or mentioned herein.

The markings allow the center-point of a resistance band to be easily and accurately determined by a user. By allowing the center-point to be easily and accurately determined, the markings ensure that a user of the resistance band steps upon the proper area for use of the resistance band in specific exercises.

The markings preferably allow users to determine points of placement of the feet and/or hands during use to ensure that users hold equal lengths of the resistance band in their separate hands thereby ensuring that the resistance level in each separate hand is equal. A user is thus able to receive the desired symmetry in their workout and the desired results.

The markings preferably ensure that a user hold equal lengths of the resistance band in their separate hands. In one embodiment, the markings on the resistance band correspond to the amount of free weights that a user would be lifting, and this correspondence of markings to free weights would be determined for each resistance band and marking the resistance band appropriately. Thus, a user would know a free weight equivalent if the user was in fact using dumbbells instead of the resistance band, or switching from dumbbells, a user would know which resistance band to use (or purchase).

The resistance band's main body preferably has a tubular shape.

Alternatively, the resistance band's main body is a flat band.

The main body is preferably composed of a material selected from latex rubber, thermoplastic elastomers and polyamides.

The markings are preferably a design selected from one of tiger striped, oval, ellipsis, hash tags, images, handprint shapes and footprint shapes.

Alternatively, each of the markings is of a multicolor.

The resistance band has a handle on each end of the main body. The handles are one of loops, tubular handles of foamed plastic, tubular handles of a rubber material about such loops, or permanent bracket handles.

The resistance band's main body preferably has a length ranging from 24 inches to 72 inches and more preferably from 48 inches to 62 inches. The markings are preferably between 2-4 inches in length.

Another aspect of the present invention is an exercise device. The exercise device is comprised of a resistance band, two couplings and two elastic bands.

The resistance band preferably has a main body with two ends and a center point. The first half of the main body preferably extends from the center point to the first end and the second half of the main body preferably extends from the center point to the second end. The band includes four markings: a first marking positioned between the center point and the first end on the first half of the main body, a second marking positioned between the center point and the second end on the second half of the main body, a third marking positioned between the first marking and the first end of the main body, and a fourth marking positioned between the second marking and the second end of the main body.

A first coupling has a main body with a recess for receiving the first end of the resistance band's main body, the main body of the first coupling also has several slots.

A second coupling has a main body with a recess for receiving the second end of the resistance band's main body, the main body of the second coupling also has several slots.

The main bodies of the couplings preferably have a diameter ranging from 1.5 inches to 3.0 inches.

The slots on each of the couplings preferably includes a first arc-like slot and a second arc-like slot.

A first elastic band, which has a hand grip, is positioned in the slots of the first coupling.

A second elastic band, which has a hand grip, is positioned in the slots of the second coupling.

The resistance band's main body preferably has a tubular shape.

Alternatively, the resistance band's main body is a flat band.

The main body is composed of a material selected from latex rubber, thermoplastic elastomers and polyamides.

The markings are preferably a design selected from one of tiger striped, oval, ellipsis, hash tags, images, handprint shapes and footprint shapes.

Alternatively, each of the markings is of a multicolor.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
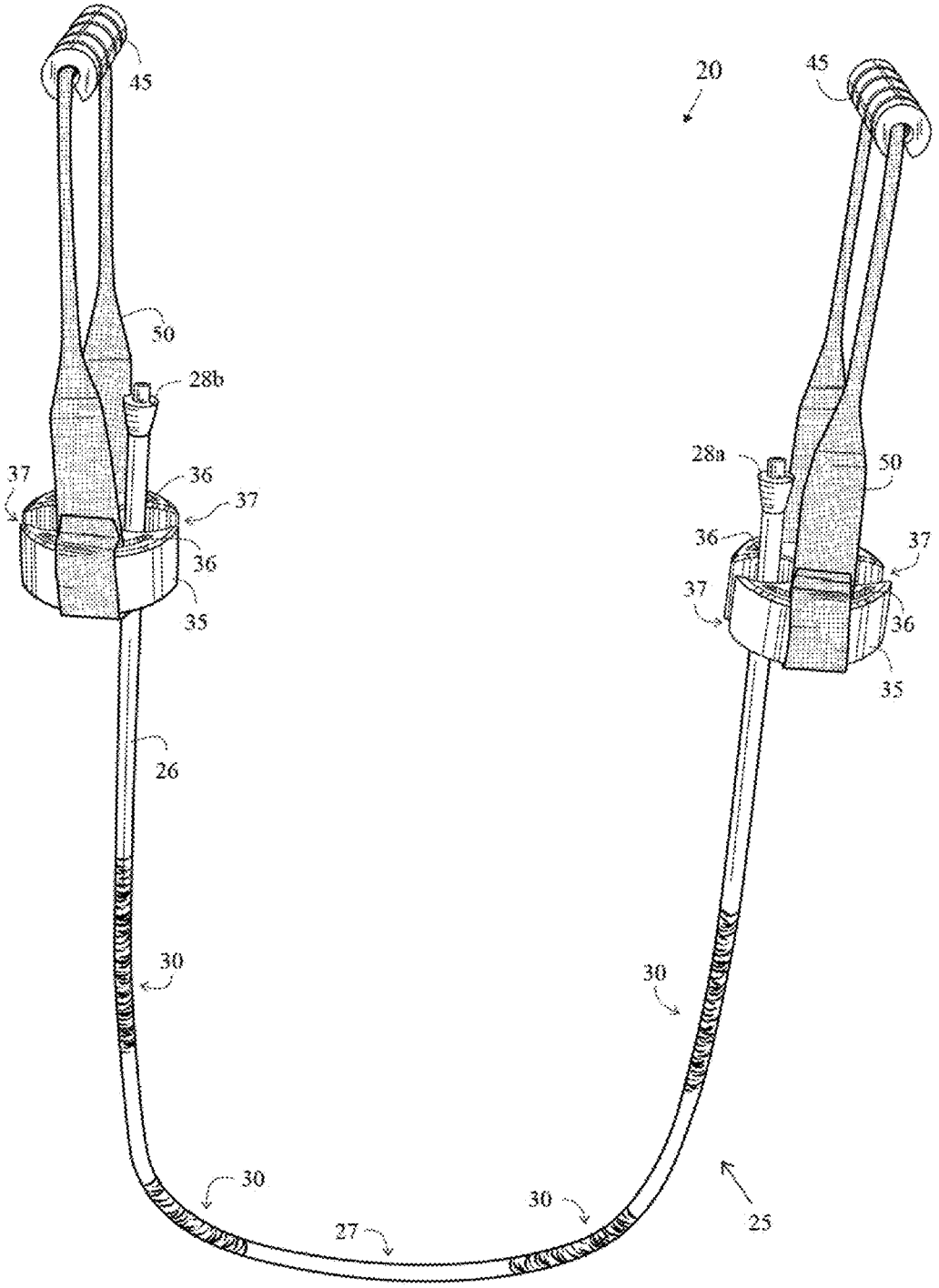
FIG. 1 is an illustration of a preferred embodiment of a resistance band with markings.

As shown in FIG. 1, a preferred embodiment of the present invention is an exercise device generally designated 20. The exercise device is comprised of a resistance band 25, two couplings 35, and two nylon straps 50. The resistance band 25 has a main body 26, two ends 28*a*-28*b*, and a center point 27, the center point 27 being equidistant from each end 28*a*-28*b*. The band's 25 main body 26 preferably has a tubular shape composed of a material selected from latex rubber, thermoplastic elastomers and polyamides. Alternatively, the main body 26 can be a flat band.

One half of the main body 26 extends from the center point 27 to the first end 28*a* and a second half of the main body 26 extends from the center point 27 to the second end 28*b*. Markings 30 on the band's main body 26 are, preferably, strategically placed at points between the center 27 and an end 28*a*-28*b*, on both halves of the band 25. Preferably, the markings 30 on each half of the band 25 are positioned such that a first marking is positioned between the center point 27 and an end 28 and a second marking is positioned between the first marking and an end 28 so that each half has two markings, thus, four total markings for the entire length of the resistance band as shown in FIG. 1.

Each of the markings 30 is a design selected from one of tiger stripes, ovals, ellipsis, hash tags, images, handprint shapes and footprint shapes. Alternatively, each of the markings 30 is of a multicolor.

Figure 8:
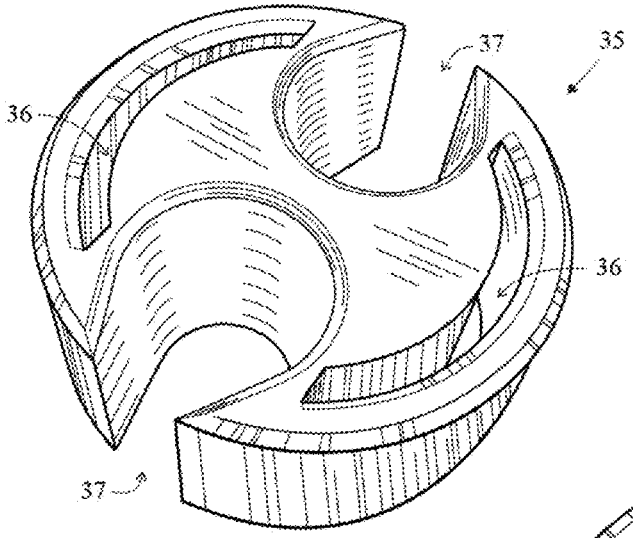
FIG. 8 is an enlarged view of the components at the end of the band's main body of a resistance band with markings.
Figure 9:
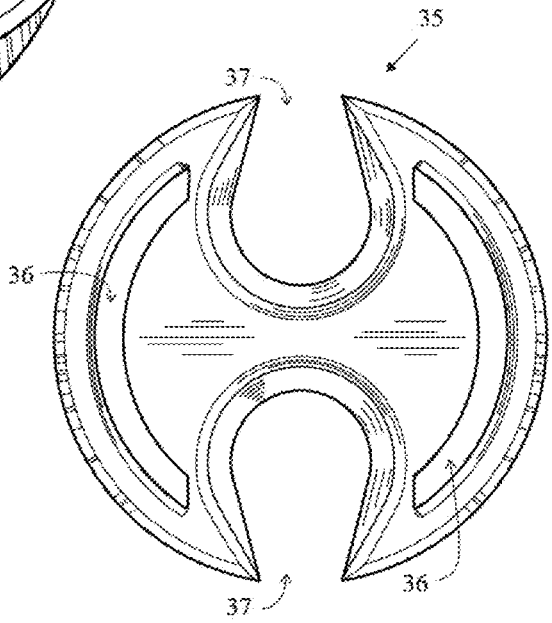
FIG. 9 is an illustration of an alternative method of utilizing a resistance band with markings.
Figure 10:
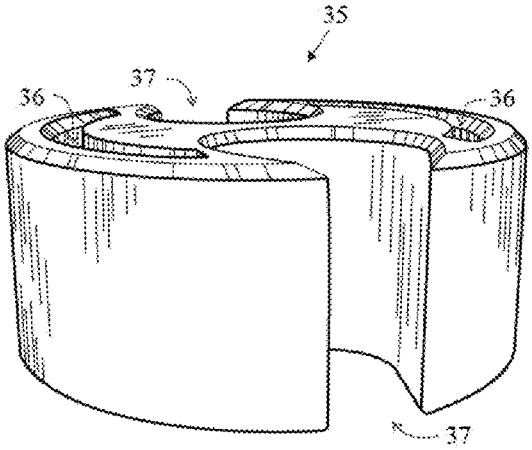
FIG. 10 is a plan view of a coupling of a resistance band with markings.

A coupling 35 is shown in FIGS. 8-10. The couplings 35 each have a main body with a recess 37 for receiving one end 28 of the main body 26 of the resistance band 25. The main body of the couplings 35 each have a diameter ranging from 1.5 inches to 3.0 inches, with a width of 2.25 inches and a height of 1 inch. The depth of the recess 37 is 1 inch. Each coupling 35 also preferably has two slots 36. The slots 36 preferably are shaped like an arc, set 0.1875 inches from the outer edge of the body of the coupling 35 to the outer edge of the slot 36.

Figure 1A:
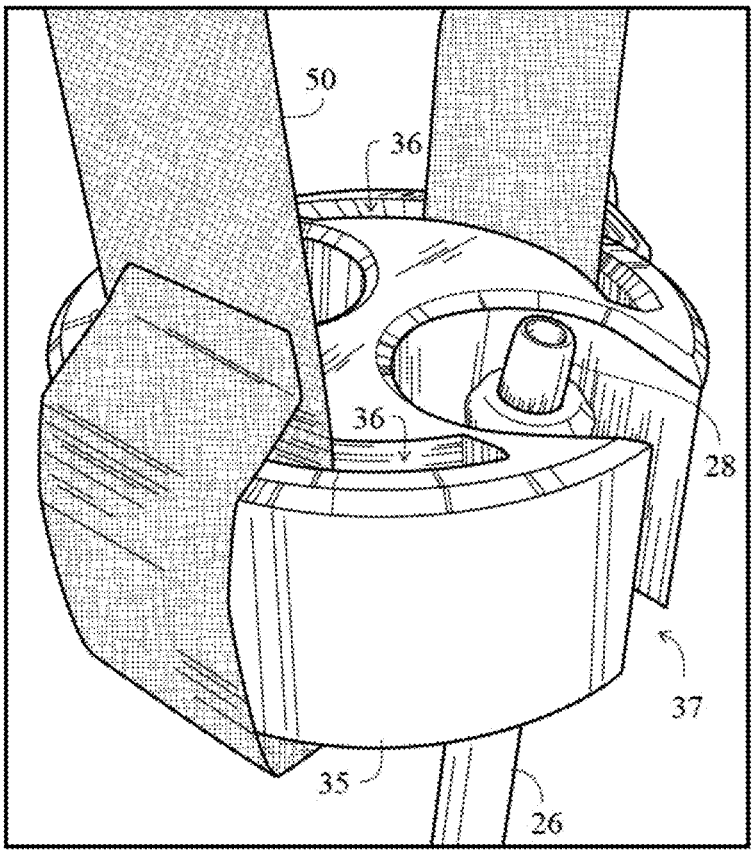
FIG. 1A is an enlarged view an elastic band with a hand grip of a resistance band with markings.

The nylon straps 50, or alternatively, elastic bands 40, each have a hand grip 45 and are positioned in the slots 36 of a coupling 35, each nylon strap 50 in a separate coupling 35, as shown in FIG. 1 and as shown detailed in FIG. 1A.

Figure 7:
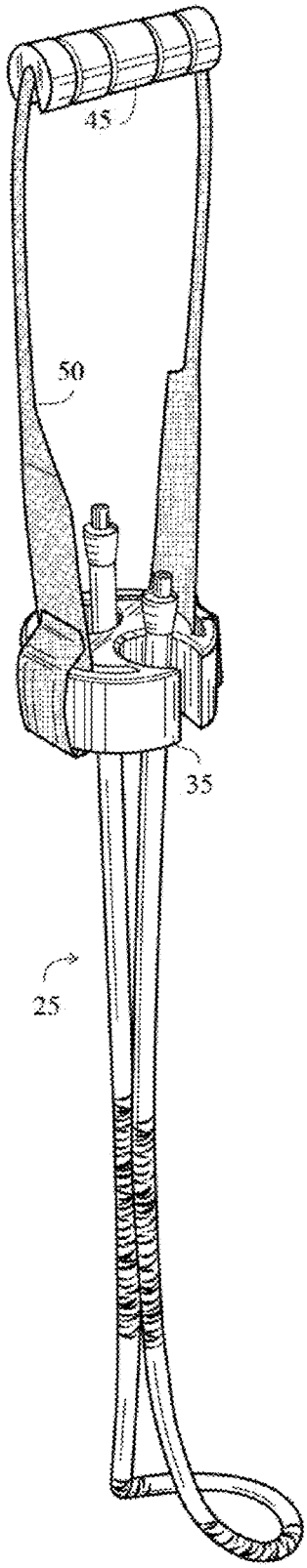
FIG. 7 is a side view of a coupling of a resistance band with markings.

FIG. 1A is an enlarged view of a nylon strap 50 attached to a coupling 35. The nylon strap 50 is shown with each end on of a strap 50 looped through the slots 36 of a coupling 35 and pulled up over the exterior body of the coupling 35 with each end of the nylon strap 50 attached to itself in such a way the main body of the nylon strap 50 forms a closed loop, as shown in FIG. 7. The configuration described allows for handles 45 (shown), wrist and ankle straps, door anchors, and other products to be quickly changed out or attached to the nylon strap 50 in order to use the resistance band 25 in any type of workout. The coupling 35 allows for a multi-tasking resistance band, the coupling 35 having the ability to be attached to anything via the nylon strap 50.

The resistance band 25 can feature various types of handles 45 at the endpoints 28 of its resistance bands, such as but not limited to loops, with or without encasing tubular handles of either foamed plastic or rubber material about such loops, and permanent bracket handles, which can be made of various durable materials. The handles 45 may take other forms which are known in the art, such as the Multiply Slotted Exercise Handgrip, disclosed in U.S. Pat. No. 6,923,750, which is hereby incorporated by reference in its entirety, the Retained Impinger Handgrip Assembly, disclosed in U.S. Pat. No. 7,147,592, which is hereby incorporated by reference in its entirety, and the Chest Expander Handle, disclosed in U.S. Patent Application Number 20060105893, which is hereby incorporated by reference in its entirety.

The resistance band 25 is preferably produced in various lengths and widths or diameters, including models of length that are for specific use by children. The resistance band 25 is preferably made in multiple formats that feature various individual resistance levels and in varying lengths and widths/diameters for use in specific exercise regimens. The resistance band 25 preferably includes, or solely consist of, notation of resistance levels at their individual points. Alternatively, the resistance band 25 contains multiple units of resistance bands of varying resistance levels in single retail packaging units. In said variation, the resistance straps each have their own handles, or only a single set of two handles is included in final packaging for attachment by various means to the individual resistance straps when in use. The resistance band 25 is used in many regular resistance-band exercises, such as but not limited to shoulder presses, lateral raises, squats, upright rows, upper-back rows and lower-back "good morning" exercises.

Figure 2:
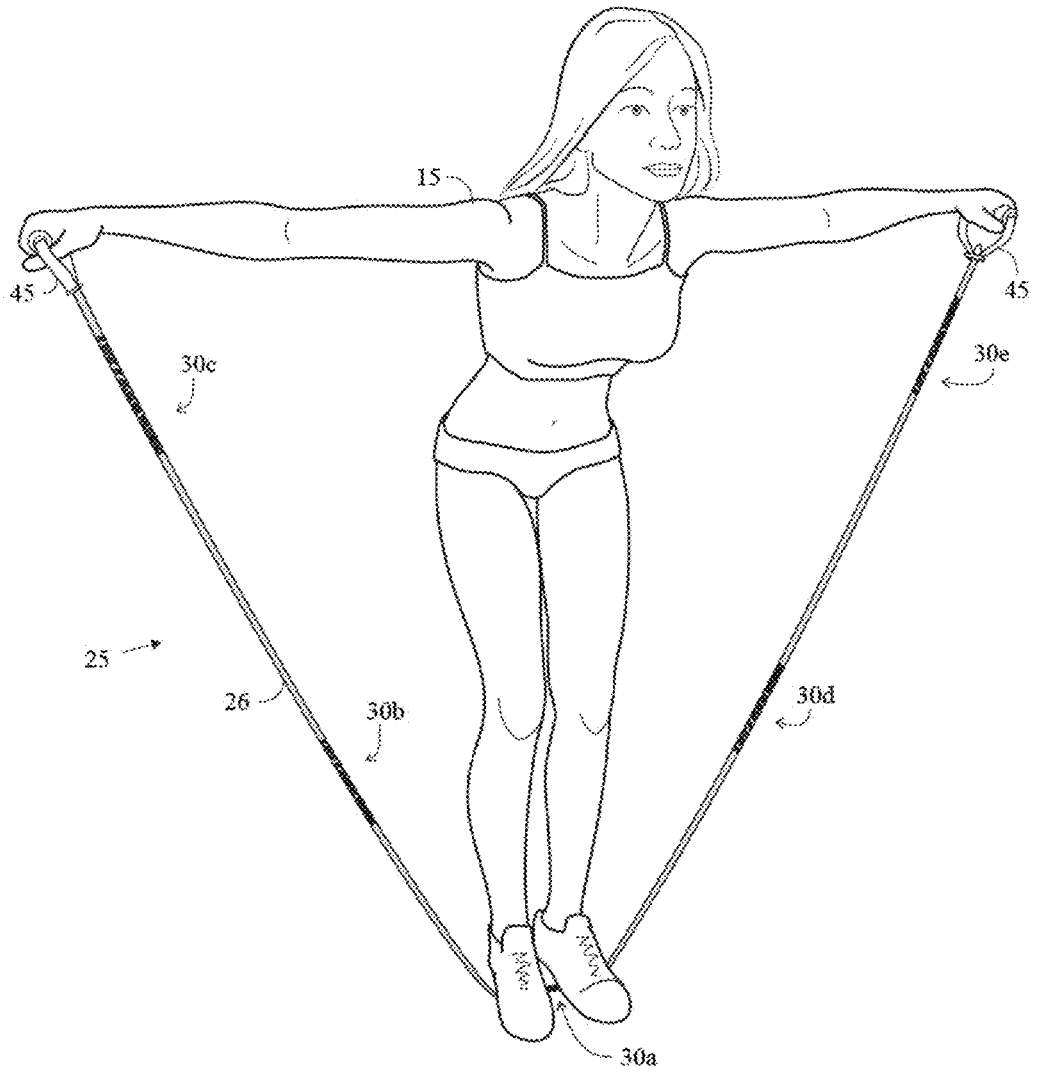
FIG. 2 is an example illustration of use of a resistance band with markings.
Figure 3:
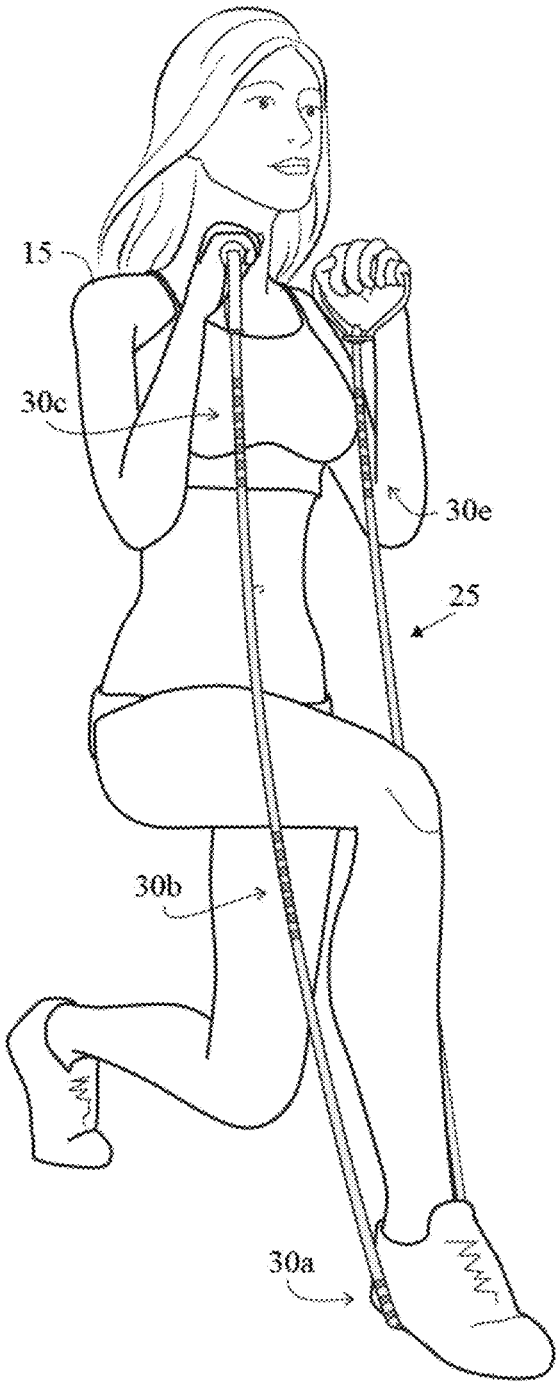
FIG. 3 is another example illustration of use of a resistance band with markings.

FIGS. 2-3 illustrate the resistance band 25 in use. A user 15 selects an appropriate and desired resistance level of resistance band 25 to use in various strength-conditioning exercises. For exercises that require the user 15 to stand upon a center-point of the resistance band 25, the center marking 30*a* of the band 25 facilitate the user 15 to quickly and accurately identify the center-point of the resistance band 25. The other markings 30*b*-30*e* at appropriate points allow users of the band 25 to easily and accurately determine proper placement of both feet and hands for particular exercises. The user 15 then quickly begins such exercises without interruption imposed upon themselves or upon others, if in a class environment, in the same exercise program. The user 15 also quickly and accurately identifies other proper standing or hand-gripping points upon the band 25 in exercises that require such placement(s). When performing such exercises, the user 15 maintains intended equal resistance levels on both sides of the band 25 and therefore achieves desired results and symmetry. The resistance band 25 also allows users to engage in an aerobic format of the typically-anaerobic category of strength training.

Maintaining equal resistance on the lateral ends of a resistance band eliminates distortion in resistance that could displace the elasticity of the resistance band. Preventing distortion of resistance and displacement of elasticity prevents damaging wear upon the resistance band, thereby extending the overall lifetime of the resistance band. With an extended lifetime of the resistance band, the cost of replacement is reduced for users.

The resistance band 25 benefits new resistance-band users and attracts new persons to this field of exercise. The markings 30 on the band 25 enable new users to quickly adapt to their proper use, thereby eliminating a generation of disinterest due to difficulty in first use and maintaining user interest in such methods of exercise. The interest and continued use creates user satisfaction in such methods of exercise, which ultimately leads to helping promote general health and proper fitness.

The resistance band 25 also benefits exercise class attendees. With the resistance band 25, users do not need to interrupt instructors and other participants in exercise classes due to delay in determining proper standing and/or gripping points. The ease of use of knowing proper placement of hands/feet using the visual markings 30 on the band 25 ensures that users can keep up in pace with others in exercise classes. Users are able to quickly and accurately determine proper standing and/or gripping points upon resistance bands 25 while in exercise classes, thus enabling users to quickly follow instructors and maintain synchronicity with instructors while engaging in relevant exercise classes. Users do not miss out on any portion of instructed exercise due to inability to quickly determine proper standing and/or gripping points. Users achieve desired symmetrical results from exercise classes.

FIGS. 4A-4F show samples of the different markings 30 of a segment of the resistance band 25. The differently-shaded areas indicate different color surfaces of the band's 25 main body 26 and of the markings 30 but are not intended to limit the colors. The white unshaded areas specifically in FIGS. 4A-4F depict the color white. The specific markings 30 are at particular points of length on the resistance band 25. The placement of markings 30 are not limited to only the illustrated positions shown in any FIG. The lengths between the marked segments of the band 25 can vary, as can the number of marked segments and their size.

Figures 4A, 4B, 4C, 4D, 4E, 4F:
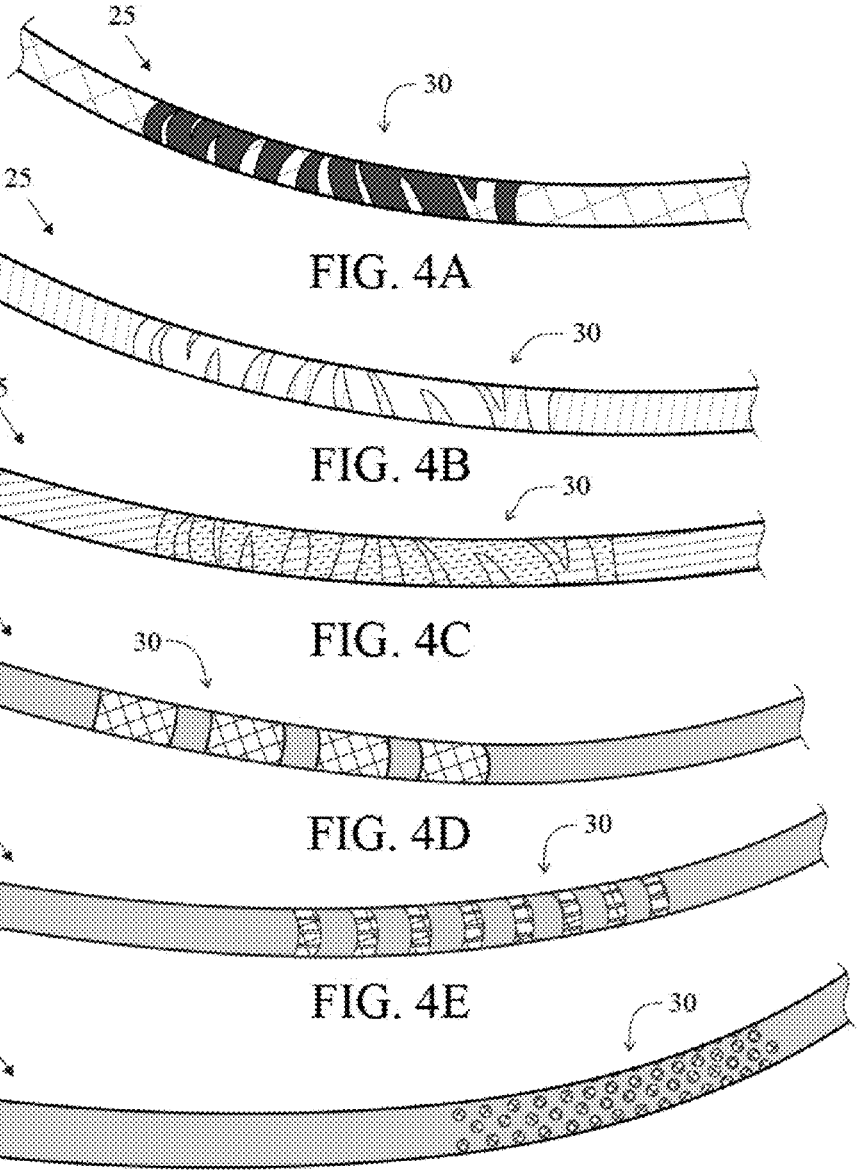
FIG. 4A is an enlarged view of the markings of a preferred embodiment of a resistance band with markings.
FIG. 4B is an enlarged view of an example of the markings of an embodiment of a resistance band with markings.
FIG. 4C is an enlarged view of an example of the markings of an embodiment of a resistance band with markings.
FIG. 4D is an enlarged view of an example of the markings of an embodiment of a resistance band with markings.
FIG. 4E is an enlarged view of an example of the markings of an embodiment of a resistance band with markings.
FIG. 4F is an enlarged view of an example of the markings of an embodiment of a resistance band with markings.

FIG. 4A is an example of a preferred embodiment of a resistance band 25 with an orange body and black tiger stripes 30. FIG. 4B is an example of a resistance band 25 with a red body and white tiger stripes 30. FIG. 4C is an example of a resistance band 25 with a blue body and black tiger stripes 30. FIGS. 4D-4F are examples of resistance bands 25 with a purple body and various orange designs 30.

Preferably, there are four tiger striped segments 30, the marked segments 30 on each half of the band 25 are positioned such that a first marking is positioned between the center point 27 and an end 28 and a second marking is positioned between the first marking and an end 28 so that each half has two markings, thus, four total markings for the length of the resistance band 25. An example of four marked segments 30 on a resistance band 25 can be seen in FIG. 1 and FIG. 12. The markings ensure that a user of the resistance band 25 steps on the proper location while using the band 25 in specific exercises correct position. The markings 30 allow users to determine points of placement of the feet and/or hands during use to ensure that the resistance level in each separate hand is equal in order to achieve the desired symmetry in workout and in workout results. The visual markings 30 allow other length-points of the resistance band to be easily and accurately determined, as well. The featured markings 30 of equal distance-lengths at other appropriate and non-center points of the resistance band 25 ensure that the same results of equal resistance and symmetry can be achieved in various other resistance-band exercises.

Alternatively, there are five tiger striped segments 30, the first marked segment applied at the lengthwise center 27 of the resistance band 25. The remaining segments are each placed twelve inches (12") away from the centered segment, with two extending to the left of the center and two extending to the right. An example of five marked segments 30 on a resistance band 25 can be seen in FIGS. 2-3.

The markings 30 that note each segment of the resistance band 25 can be applied by various means, such as but not limited to, secondary-application coloring, completely separate structural segments applied to the base, and secondary-application color pieces applied upon or encircling the structure. All such noted variations can be of various shapes and widths. In the lattermost variation, the extending height of said secondary-application color pieces may vary, and the pieces may or may not be made of the same material as the resistance band.

The markings 30 that note each segment of the resistance band 25 can be of rectangular and/or non-rectangular varieties, such as but not limited to tiger stripes, ovals, ellipsis, hash tags, images, handprint shapes and footprint shapes. The markings 30 can be of various colors that contrast with the main body 26 color of the resistance band 25, and more than one color may be used for those markings 30.

The markings 30 that note each segment of the resistance band 25 can include, or solely consist of, notation of resistance levels at their individual points. The markings 30 can be multi-colored, such as using various colors to separately indicate the resistance level of individual units. The resistance band 25 can also feature logos and/or images, which may or may not be of registered trademark and/or copyright status, at various locations, such as but not limited to markings of length segments.

Figure 5:
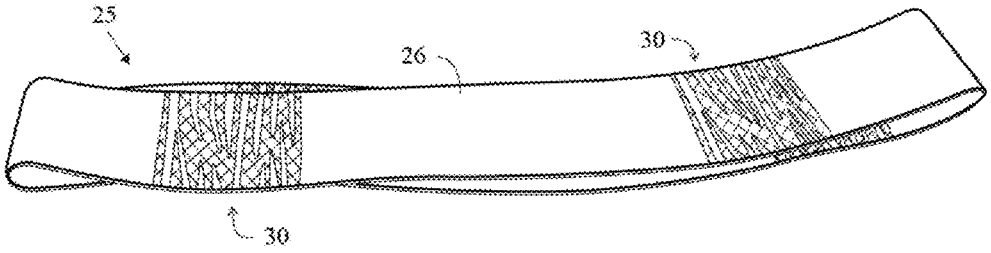
FIG. 5 is an illustration of a main body shape of an alternative embodiment of a resistance band with markings.

FIG. 5 shows an alternative embodiment of the present invention. FIG. 1 showed an embodiment of the present invention where the resistance band 25 has a tubular body 26 with two open ends 28. Alternatively, the band 25 can have a flat body 26, as shown in FIG. 5. The band 25 may also be produced in both forms for the body 26. Also shown in FIG. 5 is a closed design, such that the body 26 forms a ring instead of having two open ends. Alternatively, the body 26 can be formed in a figure-eight design.

The resistance band 25 can be produced of various materials of applicability, such as but not limited to latex rubber and thermoplastic elastomers (TPE) of polyurethane (PU) and polyamide formats. The band 25 can be made in variations that apply, permanently or removable, to walls, pulleys, exercise machines and other structures. The resistance band 25 can be identified by various commercial names for various product types, such as but not limited to exercise band, therapy band and fitness tubing. The band 25 can include various accessories in its final packaging, including but not limited to a door anchor, ankle straps, carry bag, and instructions for use or types of use. In such latter accessory, the instructions may be printed or be included on a digital video disc (DVD); said instructions may also be from a notable figure in the field of exercise and/or athletics, and with or without noted sponsorship of the product.

The resistance band 25 improves the safety of exercise with resistance bands, and reduces the risk of recoil from resistance bands. Unexpected and uneven pulls by the resistance band is thereby prevented, which further enables a user to maintain their grip on the resistance band and thus avoid injuries resulting from a recoiling uncontrollable band.

Figure 6:
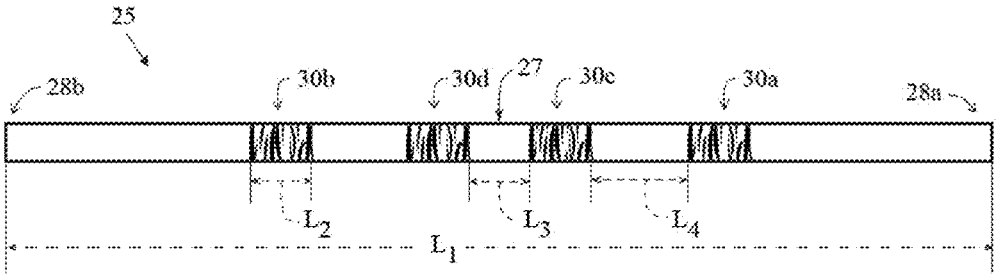
FIG. 6 is a block diagram showing measurements of the preferred embodiment of a resistance band with markings.

FIG. 6 shows the resistance band 25 lengthwise. The resistance band's 25 main body 26 preferably has a length $L_1$ ranging from 24 inches to 72 inches, and more preferably from 48 inches to 62 inches. There are preferably four segments of markings 30*a*-30*d* on the resistance band 25, each segment 30*a*-30*d* is preferably tiger stripes that are 3 inches in length $L_2$. The first tiger striped segment 30*a* is positioned between the center point 27 and the first end 28*a* on the first half of the main body, a second marking 30*b* positioned between the center point 27 and the second end 28*b* on the second half of the main body, a third marking 30*c* positioned 3.375 inches in length $L_4$ from the first marking 30*a* between the first marking 30*a* and the center 27, and a fourth marking 30*d* positioned 3.375 inches in length from the second marking 30*b* between the second marking 30*b* and the center 27, so that the third 30*c* and fourth markings 30*d* are 3 inches in length $L_2$ apart. The lengths between the marked segments 30 of the band 25 can vary, as can the number of marked segments and the sizes of each segment.

Figure 6A:
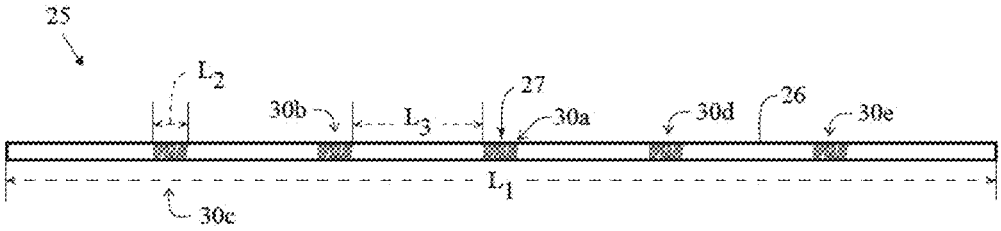
FIG. 6A is a block diagram sowing measurements of an alternative embodiment of a resistance band with markings.

FIG. 6A shows an alternative embodiment of the resistance band 25 lengthwise. The resistance band's 25 main body 26 preferably has a length $L_1$ ranging from 24 inches to 72 inches, and more preferably from 48 inches to 72 inches. There are preferably five segments of markings 30*a*-30*e* on the resistance band 25, each segment 30*a*-30*e* is preferably tiger stripes that are 3 inches in length $L_2$. The first tiger striped segment 30*a* is applied at the lengthwise center 27 of the resistance band 25. The remaining segments 30*b*-30*e* are preferably each placed twelve inches in length $L_3$ of distance away from each other, starting from the centered segment 30*a*, with two segments 30*b*-30*c* extending to the left of the center and two segments 30*d*-30*e* extending to the right. The lengths between the marked segments 30 of the band 25 can vary, as can the number of marked segments and the sizes of each segment.

Figures 11, 11A, 12:
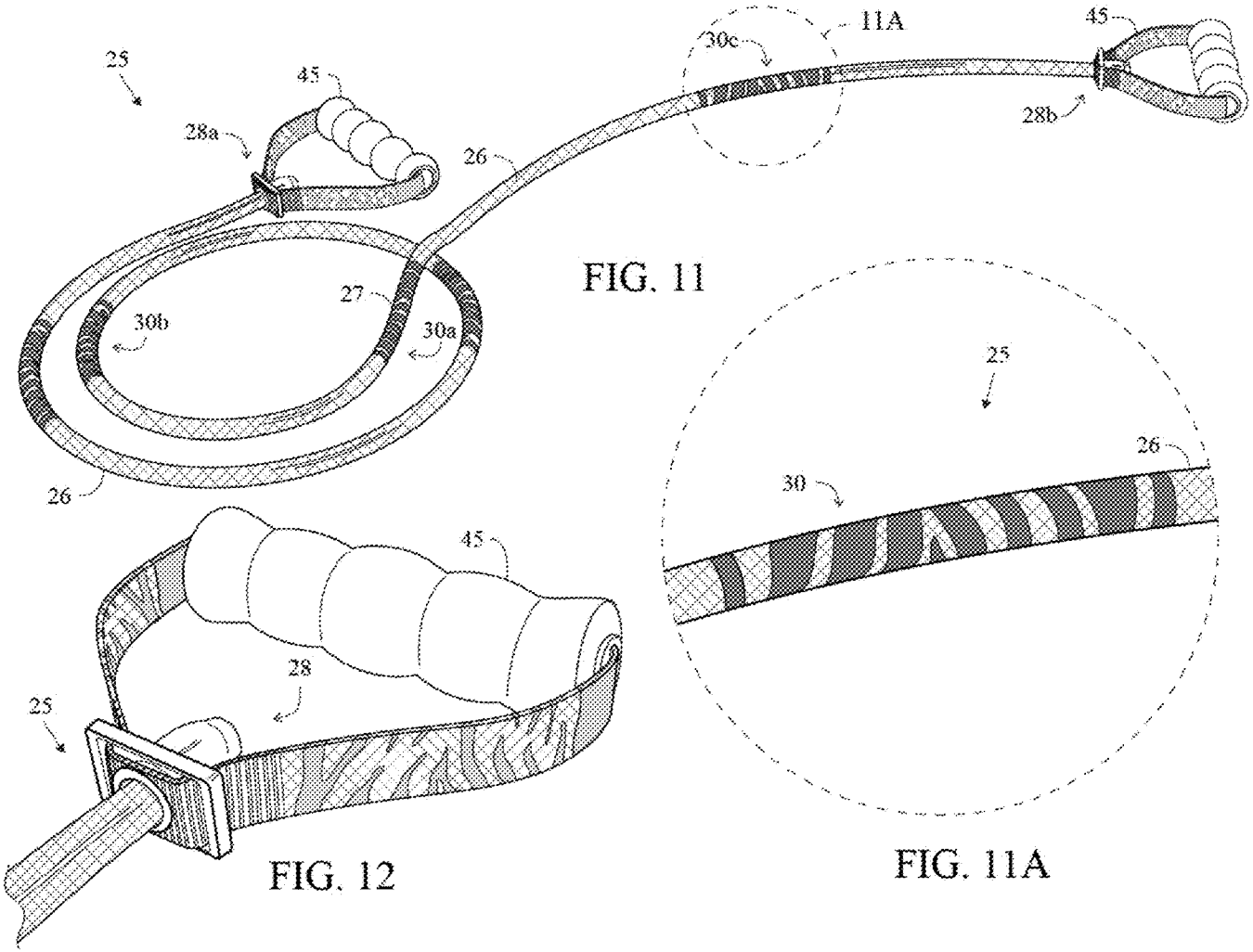
FIG. 11 is an illustration of an alternative embodiment of a resistance band with markings.
FIG. 11A is an enlarged view of the markings of an embodiment of a resistance band with markings.
FIG. 12 is an enlarged view of an elastic band with a hand grip of a resistance band with markings.

FIGS. 11-12 illustrate an alternative embodiment of the present invention.

As shown in FIG. 11, an alternative embodiment of the present invention is a resistance band 25. The resistance band 25 has a main body 26, two ends 28*a*-28*b*, and a center point 27; the center point 27 being equidistant from each end 28*a*-28*b*. One half of the main body 26 extends from the center point 27 to the first end 28*a* and a second half of the main body 26 extends from the center point 27 to the second end 28*b*. Markings 30*a*-30*e* on the band's main body 26 are, preferably, strategically placed at points between the center 27 and an end 28*a*-28*b*, on both halves of the band 25.

FIG. 11A is an enlarged view of a section of marking 30 on the main body 26 of the resistance band 25. The colors are also illustrated, with the main body 26 as orange and the tiger stripe markings 30 as black. Each segment of markings 30 is a design, preferably selected from one of tiger stripes, ovals, ellipsis, hash tags, images, handprint shapes and footprint shapes. Alternatively, each segment of markings 30 can be a solid color or multicolored.

Featured at each of the endpoints 28 of the resistance band 25 are handles 45, as shown in FIG. 12. The handles 45 are preferably loop, made of woven polyester, and these loop handles preferably have a total length of 9 inches when unobstructed and unattached. In the center area of these loop handles are cylindrical encasements of a foam rubber material of 5 inches in length. The foam rubber is of closed-cell format upon its exterior plane.

The resistance band 25 of the present invention is capable of multiple different formats, including but not limited to factors of lengths, appearance of markings, colors, styles and logos, and is in no way limited to the embodiments described herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

We claim as our invention the following:

1. A resistance band comprising:

a main body having a first end, a second end and a center point, wherein a first half of the main body extends from the center point to the first end and a second half of the main body extends from the center point to the second end;

a first marking positioned between the center point and the first end on the first half of the main body;

a second marking positioned between the center point and the second end on the second half of the main body;

a third marking positioned between the first marking and the first end of the main body;

a fourth marking positioned between the second marking and the second end of the main body; and a first handle on the first end and a second handle on the second end, the first handle and the second handle consisting of one of loops, tubular handles of foamed plastic, tubular handles of a rubber material about such loops and bracket handles;

wherein the markings ensure that a user of the resistance band steps upon the proper location for use of the resistance band in specific exercises.

2. The resistance band according to claim 1 wherein the markings allow users to determine points of placement of the feet and/or hands during use to ensure a symmetrical workout and results.

3. The resistance band according to claim 1 wherein the markings ensures that a user hold equal lengths of the resistance band in their separate hands.

4. The resistance band according to claim 1 wherein the main body has a tubular shape.

5. The resistance band according to claim 1 wherein the main body is a flat band.

6. The resistance band according to claim 1 wherein the main body is composed of a material selected from latex rubber, thermoplastic elastomers and polyamides.

7. The resistance band according to claim 1 wherein each of the markings is a design selected from one of tiger striped, oval, ellipsis, hash tags, images, handprint shapes and footprint shapes.

8. The resistance band according to claim 1 wherein each of the markings is of a multicolor.

9. The resistance band according to claim 1 wherein the main body has a length ranging from 24 inches to 72 inches.

10. An exercise device comprising:

a resistance band comprising a main body having a first end, a second end and a center point, wherein a first half of the main body extends from the center point to the first end and a second half of the main body extends from the center point to the second end, a first marking positioned between the center point and the first end on the first half of the main body, a second marking positioned between the center point and the second end on the second half of the main body, a third marking positioned between the first marking and the first end of the main body, and a fourth marking positioned between the second marking and the second end of the main body;

a first coupling having a main body with recess for receiving the first end of the main body of the resistance band, the main body of the first coupling having a plurality of slots;

a second coupling having a main body with a recess for receiving the second end of the main body of the resistance band, the main body of the the second coupling having a plurality of slots;

a first elastic band with a hand grip, the first elastic band positioned in the plurality of slots of the first coupling; and a second elastic band with a hand grip, the second elastic band positioned in the plurality of slots of the second coupling.

11. The exercise device according to claim 10 wherein the main body of the first coupling has a diameter ranging from 1.5 inches to 3.0 inches, and the main body of the second coupling has a diameter ranging from 1.5 inches to 3.0 inches.

12. The exercise device according to claim 10 wherein the plurality of slots of the first coupling includes a first arc-like slot and a second arc-like slot, and the plurality of slots of the second coupling includes a first arc-like slot and a second arc-like slot.

13. The exercise device according to claim 10 wherein the main body has a tubular shape.

14. The exercise device according to claim 10 wherein the main body is a flat band.

15. The exercise device according to claim 10 wherein the main body is composed of a material selected from latex rubber, thermoplastic elastomers and polyamides.

16. The exercise device according to claim 10 wherein each of the markings is a design selected from one of tiger striped, oval, ellipsis, hash tags, images, handprint shapes and footprint shapes.

17. The exercise device according to claim 10 wherein each of the markings is of a multicolor.

18. The exercise device according to claim 10 wherein each of the markings has a length ranging from 2 to 4 inches.

* * * * *